United States Patent [19]

Taylor et al.

[11] 4,184,456

[45] Jan. 22, 1980

[54] COAL FEED SYSTEM FOR A FLUIDIZED BED COMBUSTOR

[75] Inventors: Thomas E. Taylor, Bergenfield; Richard W. Bryers, Flemington, both of N.J.

[73] Assignee: Foster Wheeler Energy Corporation, Livingston, N.J.

[21] Appl. No.: 944,102

[22] Filed: Sep. 20, 1978

[51] Int. Cl.[2] ..... F22B 1/00

[52] U.S. Cl. ..... 122/4 D; 110/220; 110/101 R; 110/245; 431/170

[58] Field of Search ..... 122/4 D; 110/245, 263, 110/218, 219, 220, 101 R, 101 C, 101 CF; 431/7, 170; 209/11

[56] References Cited

U.S. PATENT DOCUMENTS

| | | | |
|---|---|---|---|
| 955,970 | 4/1910 | Korting | 110/218 X |
| 2,650,084 | 8/1953 | White | 110/245 X |
| 3,515,381 | 6/1970 | Foch | 110/245 X |
| 3,716,003 | 12/1973 | Battcock | 122/4 D X |
| 3,981,690 | 9/1976 | Chem et al. | 110/263 X |
| 4,044,695 | 8/1977 | Mackenzie et al. | 110/220 |
| 4,154,581 | 5/1979 | Nack et al. | 110/245 X |

*Primary Examiner*—Edward G. Favors

*Attorney, Agent, or Firm*—Marvin A. Naigur; John E. Wilson; John J. Herguth, Jr.

[57] ABSTRACT

A coal feed system for use in a fluidized bed in which a grate is supported in a housing and is adapted to receive, on its upper surface, a bed of particulate material including a combustible fuel. Air is passed through the grate and into the bed to fluidize the particulate material. The particulate fuel material is separated externally of the bed into a relatively coarse material which is distributed over the upper surface of the bed and a relatively fine material which is distributed into the bed below the upper surface.

5 Claims, 1 Drawing Figure

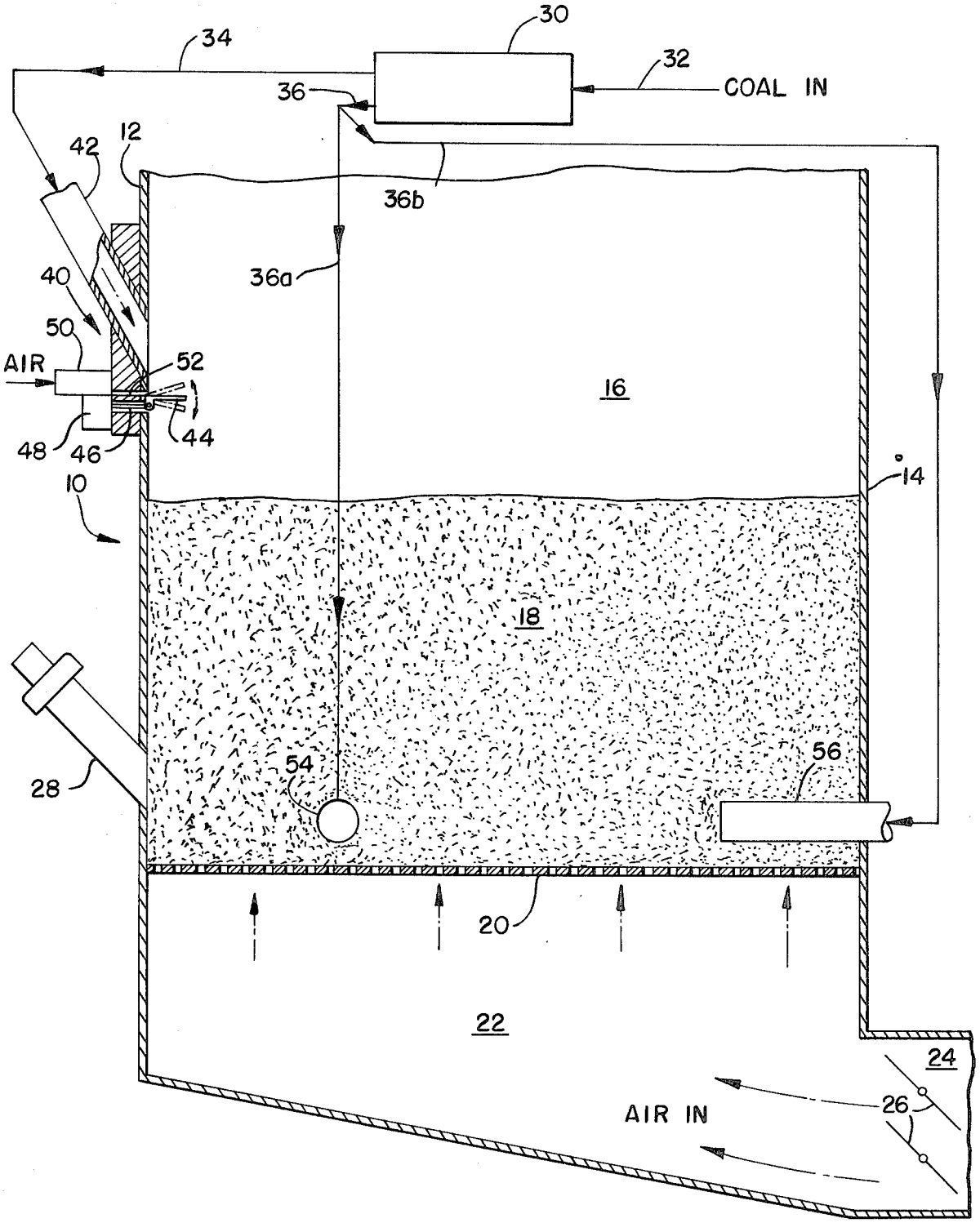
30
34
32
COAL IN
36
12
42
36b
36a
40
50
AIR
52
16
44
48
46
14
10
18
28
54
56
20
22
24
26
AIR IN

COAL FEED SYSTEM FOR A FLUIDIZED BED COMBUSTOR

BACKGROUND OF THE INVENTION

The present invention relates to fluidized beds and, more particularly, to a coal feed system for a fluidized bed combustor.

Fluidized beds have long been recognized as an attractive and effective means of generating heat. In these arrangements, air is passed through a bed of particulate material which normally consists of a mixture of inert material and a particulate fossil fuel such as coal, to fluidize the bed and to promote the combustion of the fuel. When the heat produced by the fluidized bed is utilized to convert water to steam, such as in a steam generator (boiler), the fluidized bed system offers an attractive combination of high heat release, improved heat transfer to surfaces within the bed and compact boiler size.

In both incinerator and boiler type arrangements, the particulate fuel material must be continuously, or at least periodically, distributed into the bed to replenish the spent material expended in the combustion process. Many conventional systems utilize a feeder for distributing the particulate fuel material from a position above the upper surface of the bed where it falls by gravity onto the latter surface. However, since a great majority of the commercial coal that is available is of a relatively large particle size range which may extend from very small particles to and including particles that will pass through a two-inch screen, this ejection of the particulate fuel material onto the upper surface of the bed presents problems. In particular, if the particulate fuel material is relatively small, the combination of the upwardly rising combustion gases and air passing through the bed will blow the material out the top of the combustor before it is burned.

It also has been suggested to provide in-bed feeding systems in which the particulate fuel material is introduced directly into the bed from a point below the upper surface of the bed. However, these in-bed systems present additional problems since the lateral transfer or dispersion of the materials through the bed is relatively poor requiring a multiplicity of feed points to prevent hot spots or over cool spots which increases the cost of the installation.

SUMMARY OF THE INVENTION

It is therefore an object of the present invention to provide a coal feed system for a fluidized bed combustor in which an optimum distribution of a particulate fuel material of a relatively large particle size range is achieved.

It is a further object of the present invention to provide a system of the above type in which the particulate fuel material is separated into a relatively coarse material which is distributed to the upper surface of the bed and a relatively fine material which is distributed into the bed at a point below the upper surface of the bed.

Toward the fulfillment of these and other objects, the system of the present invention comprises a fluidized bed heat exchanger comprising grate means supported in a housing and adapted to receive on its upper surface a bed of particulate material at least a portion of which is combustible. Air is passed through the grate means and the particulate material to fluidize the particulate material. A relatively coarse particulate fuel material is distributed to the upper surface of the bed and a relatively fine particulate fuel material is distributed into the bed below the upper surface of the bed.

DESCRIPTION OF THE DRAWING

The above brief description, as well as further objects, features, and advantages, of the present invention will be more fully appreciated by reference to the following detailed description of a presently preferred but nonetheless illustrative embodiment in accordance with the present invention, when taken in connection with the accompanying drawing which is a vertical sectional view of the apparatus of the present invention.

DESCRIPTION OF THE PREFERRED EMBODIMENT

Referring to the drawing, the reference numeral 10 refers in general to a fluidized bed boiler of the present invention consisting of a front wall 12, a rear wall 14, and two sidewalls, one of which is shown by the reference numeral 16. The upper portion of the boiler is not shown for the convenience of presentation, it being understood that it consists of a convection section, a roof and an outlet for allowing the combustion gases to discharge from the boiler, in a conventional manner.

A bed of particulate material, shown in general by the reference numeral 18, is disposed within the boiler 10 and rests on a perforated grate 20 extending horizontally in the lower portion of the boiler. The bed 18 can consist of a mixture of discrete particles of inert material and fuel material such as bituminous coal.

An air plenum chamber 22 is provided immediately below the grate 20 and an air inlet 24 is provided through the rear wall 14 in communication with the chamber 22 for distributing air from an external source (not shown) to the chamber. A pair of air dampers 26 are provided in the inlet 24 for controlling the flow of air into the chamber 22. The dampers 26 are suitably mounted in the inlet 24 for pivotal movement about their centers in response to actuation of external controls (not shown) to vary the effective openings in the inlet and thus control the flow of air through the inlet and into the chamber 22. Since the dampers 26 are of a conventional design they will not be described in any further detail.

A bed light-off burner 28 is mounted through the front wall 12 immediately above the grate 20 for initially lighting off the bed 18 during startup.

A separator, shown in general by the reference numeral 30 is located externally of the boiler 10 and is adapted to receive particulate fuel material, such as coal, of a relative large particle size range from an external source (not shown) via a duct 32. The separator 30 is adapted to separate the fuel material in a conventional manner into relatively coarse and relatively fine particles with the former being passed from the separator via a duct 34 and the latter via a duct 36 which branches into ducts **36*a* and 36*b*. As an example, the separator can be adapted to separate particles greater than 1/16 of an inch in diameter from those less than 1/16 of an inch and pass the former to the duct 34 and the latter to the duct 36**.

A distributor, shown in general by the reference numeral 40, is mounted relative to the upper portion of the front wall 12 and receives the relatively coarse coal particles from the duct 34 and operates to distribute the latter onto the bed 18 during startup. The distributor 40 includes an inlet pipe 42 for receiving the coarse coal particles from the duct 34 and feeding same, by gravity, onto a distributor tray 44 which extends immediately below the outlet end of the pipe 42 and into the interior of the boiler 10. The tray 44 is pivotally mounted relative to an actuating lever 46 for controlling the movement of the tray between the positions shown by the solid lines and the two positions shown by the dashed lines. A control for the lever 46 is shown in general by the reference numeral 48 and operates in a conventional manner to control the pivotal movement of the tray 44. The distributor 40 also includes an air distributor unit, shown in general by the reference numeral 50, for distributing air at a selected rate through a plurality of vanes, one of which is shown by the reference numeral 52, located immediately above the tray 44, to inject the air across the coal particles on the tray. As a result the coal particles are distributed into portions of the interior of the boiler 10 that are determined by the position of the tray 44.

A pair of pneumatic feeders 54 and 56 are provided which extend through a sidewall 16 and through the rear wall 14, respectively. The feeders 54 and 56 receive the relatively fine coal from the ducts 36*a* and 36*b*, respectively, and are adapted to introduce and feed the relatively fine coal particles into the bed 18 in a conventional manner. It is understood that a feeder or feeders identical to the feeders 54 and 56 can also be provided through the other sidewall 16 and the front wall 12 as necessary.

To startup the bed 18, the dampers 26 associated with the air inlet 24 are opened, and air is thus distributed upwardly through the compartment 22, through the perforations in the grate 20 and into the bed 18. This loosens the particulate material in the bed 18 and reduces material packing and bridging.

The light-off burner 30 is fired to heat the material in the bed 18 until the temperature of the material reaches a predetermined level, at which time the distributor 50 is activated to distribute the relatively coarse particulate fuel from the inlet pipe 42 into the upper portion of the bed 18, with the particular area of the upper surface of the bed 18 which receives the fuel material being regulated by the position of the tray 44 to insure uniform distribution across the upper surface. The relatively fine particles are distributed into the bed via the pneumatic feeders 54 and 56.

After the bed 18 has been fluidized and has reached a predetermined elevated temperature the light-off burner 30 is turned off while the distributor 40 and the feeders 54 and 56 continue to distribute particulate fuel to the bed 18 in accordance with predetermined feed rates.

It is thus seen that the present invention provides an effective yet simple method of insuring optimum distribution of particle fuel material of a relatively large particle size range.

It is understood that if the combustor is used for the purpose of steam generation, a plurality of heat exchange tubes carrying the fluid to be heated, such as water, may be routed through the interior of the boiler in a conventional manner with these tubes being omitted in the drawing for the convenience of presentation. In the event that the combustor is used for incineration the convection section, water walls, etc., may be omitted and conventional refractory construction used to contain the fluid bed.

A latitude of modification, change and substitution is intended in the foregoing disclosure and in some instances some features of the invention will be employed without a corresponding use of other features. Accordingly, it is appropriate that the appended claims be construed broadly and in a manner consistent with the spirit and scope of the invention herein.

What is claimed is:

1. A fluidized bed heat exchanger comprising a housing, grate means supported in said housing and adapted to receive on its upper surface a bed of particulate material at least a portion of which is combustible, means for passing air through said grate means and said particulate material to fluidize said particulate material, means for distributing a relatively coarse particulate fuel material to the upper surface of said bed and means for distributing a relatively fine particulate fuel material into said bed below the upper surface of said bed.

2. The heat exchanger of claim 1, further comprising separator means for receiving particulate fuel material of a relatively large particle size range and separating the fuel material into relatively coarse and relatively fine particles.

3. The heat exchanger of claim 2, further comprising conduit means for transferring said coarse and fine particles from said separator means to said distributing means.

4. The heat exchanger of claims 1 or 2 wherein said first-mentioned distributing means is adapted to distribute said fuel material at selected areas across the upper surface of said bed.

5. The heat exchanger of claims 1 or 2 wherein said second mentioned distributing means is adapted to distribute said fuel material at a plurality of selected locations below the upper surface of said bed.

* * * * *